US005558065A

United States Patent [19]

Arakawa

[11] Patent Number: 5,558,065

[45] Date of Patent: Sep. 24, 1996

[54] METHOD FOR DRIVING INJECTOR FOR INTERNAL COMBUSTION ENGINE

[75] Inventor: Yoshinobu Arakawa, Numazu, Japan

[73] Assignee: Kokusan Denki Co., Ltd., Shizuoka-Ken, Japan

[21] Appl. No.: 523,695

[22] Filed: Sep. 5, 1995

[51] Int. Cl.[6] ..... F02D 41/30

[52] U.S. Cl. ..... 123/490

[58] Field of Search ..... 123/490, 478; 361/152, 154, 155, 156; 318/599

[56] References Cited

U.S. PATENT DOCUMENTS

| | | | |
|---|---|---|---|
| 4,922,878 | 5/1990 | Shinogle et al. | 123/490 |
| 5,053,911 | 10/1991 | Kopec et al. | 361/154 |
| 5,251,091 | 10/1993 | Ito et al. | 361/152 |
| 5,287,839 | 2/1994 | Kondou et al. | 123/478 |
| 5,373,827 | 12/1994 | Kondou et al. | 123/478 |
| 5,390,641 | 2/1995 | Yamada et al. | 123/491 |
| 5,442,515 | 8/1995 | Wallaert | 361/187 |
| 5,452,700 | 9/1995 | Matsuura | 123/490 |

*Primary Examiner*—Raymond A. Nelli

*Attorney, Agent, or Firm*—Pearne, Gordon, McCoy & Granger

[57] ABSTRACT

A method for driving an injector for feeding an internal combustion engine with fuel which is capable of improving starting characteristics of the engine. A power circuit is provided which functions to charge a power capacitor utilizing an output of a generating coil, so that feeding of an injection command signal permits a driving current to flow through a driving coil of an injector. A period of time required to permit charges in an amount necessary to drive the injector to be accumulated in the power capacitor is defined to be an injector drive prohibition period, during which generation of the injection command signal is prohibited, to thereby prohibit flowing of the driving current. The injector drive prohibition period is elapsed, so that a required amount of charges are accumulated in the power capacitor, followed by generation of the injection command signal, to thereby permit the driving current to flow the driving coil.

6 Claims, 6 Drawing Sheets

Fig. 6
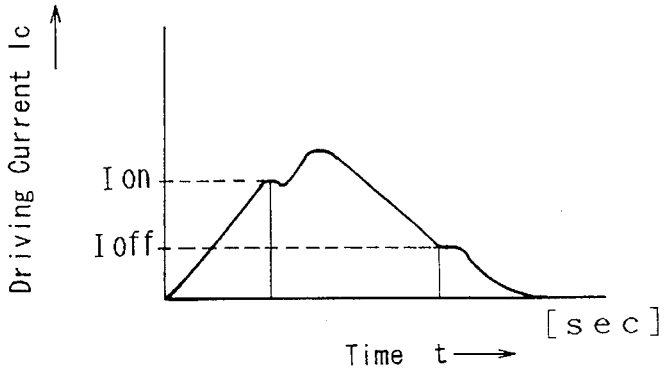
Fig. 7A
Fig. 7B
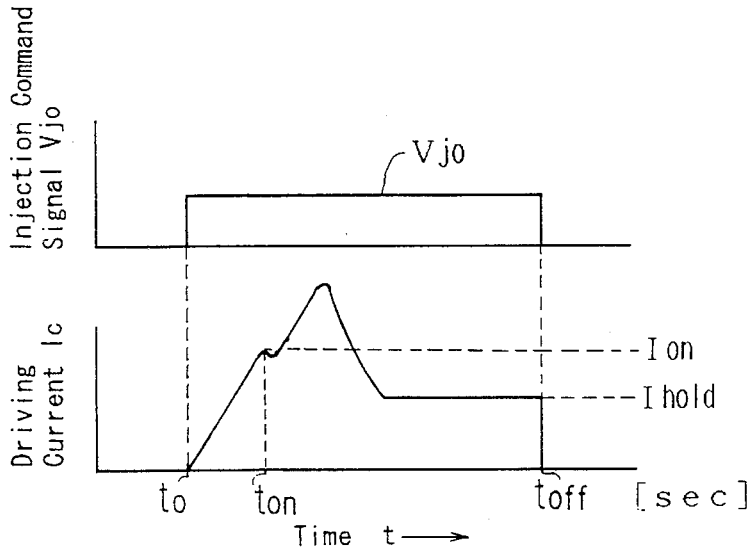
Fig. 8
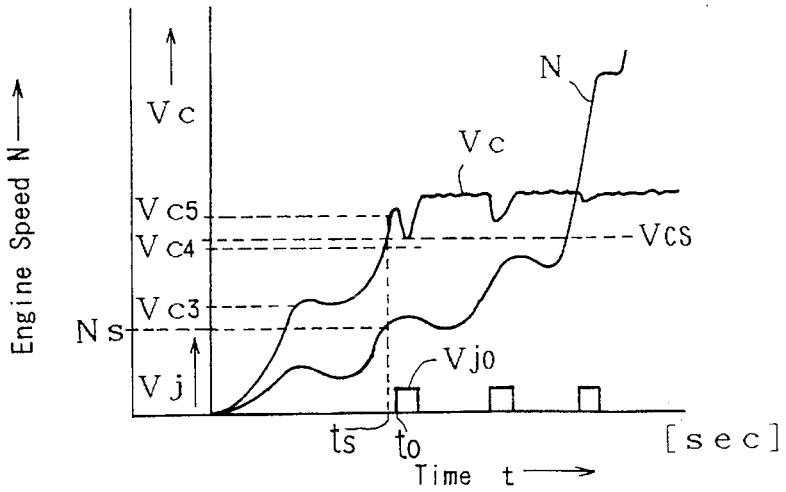

Fig. 9
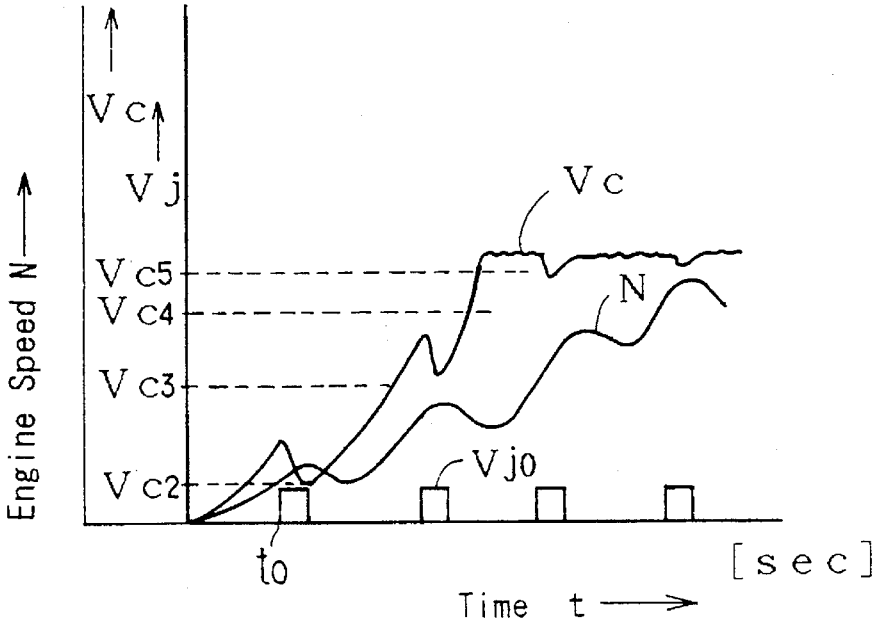
Fig. 10A
Fig. 10B
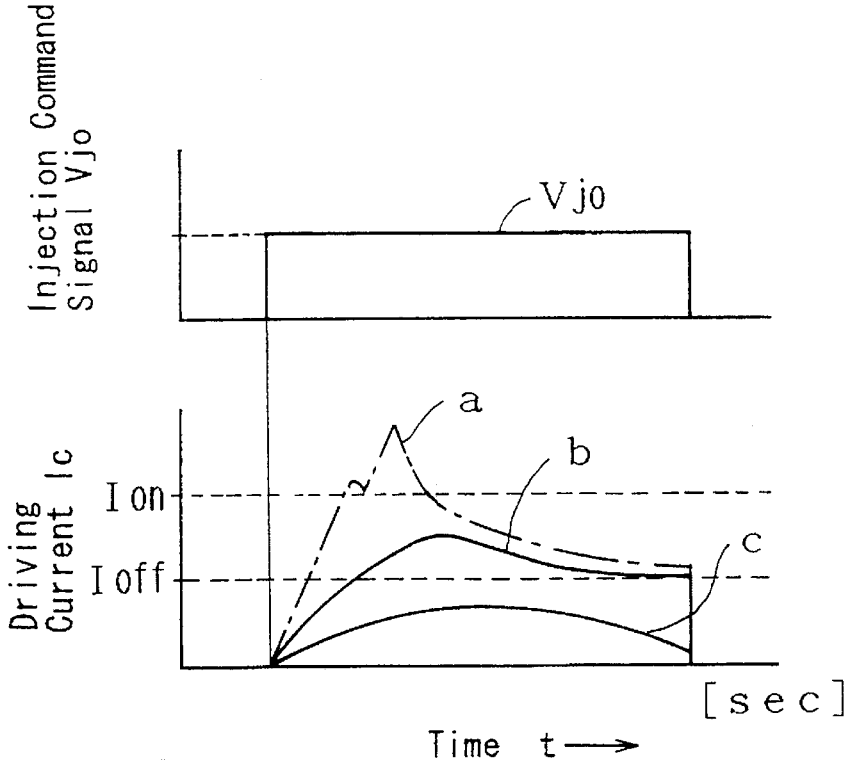

METHOD FOR DRIVING INJECTOR FOR INTERNAL COMBUSTION ENGINE

BACKGROUND OF THE INVENTION

This invention relates to an injector driving method, and more particularly to a method for driving an injector for feeding an internal combustion engine with fuel.

An injector used for feeding an internal combustion engine with fuel includes a valve for operating a fuel injection port and an electromagnet for driving the valve and is adapted to open the fuel injection port to feed fuel to the engine while a driving coil of the electromagnet is fed with a predetermined current.

For the purpose of driving the injector, a power circuit for applying a power supply voltage across the driving coil of the injector, an injection command signal generating section for generating an injection command signal of a predetermined signal width and a switch circuit connected in series to the driving coil of the injector are provided.

The injection command signal generating section is generally equipped with a microcomputer and has an output of a signal source including information on both an angle of rotation of the engine and an engine speed and outputs of various sensors such as a sensor for detecting a degree of opening of a throttle, a temperature sensor and the like inputted thereto, to thereby operate fuel injection time depending on a degree of opening of a throttle, a temperature, an atmospheric pressure, an engine speed and the like by means of the microcomputer, resulting in generating an injection command signal of a signal width corresponding to a predetermined fuel injection rate at a predetermined fuel injection start position.

The switch circuit connected in series to the driving coil of the injector is kept turned on while the injection command signal is generated, to thereby feed a driving current to the driving coil of the injector. Such feeding of the driving current to the driving coil of the injector causes the valve of the injector to be open when the driving current is increased to a predetermined level, to thereby start injection of fuel; whereas when the injection command signal is extinguished to stop feeding of the driving current to the driving coil, the valve is closed to interrupt injection of fuel. The internal combustion engine is fed with fuel in an amount determined by a product of a period of time during which the valve of the injector is kept open and a pressure of fuel fed to the injector.

Conventionally, a battery has been used as a power supply for a power circuit for driving the injector for the internal combustion engine. In addition, it has been recently considered, in order to permit the injector to be likewise applied to an engine for a vehicle, a ship or the like which is not mounted thereon with a battery, to use a power circuit in which a magneto driven by the engine is used as a power supply.

FIG. 12 schematically shows a conventional fuel injection device which was proposed by the assignee. In FIG. 12, reference numeral 1 designates a signal source, 2A is a main injection command signal generating portion, 2B is an auxiliary injection command signal generating portion, 3 is a power circuit, 4 is an injector for an internal combustion engine, 5 is a switch circuit connected in series to an exciting coil 4*a* of the injector 4, 2C is a switching circuit for feeding the switch circuit 5 with a trigger signal during a period of time for which the main injection command signal generating portion 2A generates a main injection command signal Vj or the auxiliary injection command signal generating portion 2B generates an auxiliary injection command signal Vj'. In the device of FIG. 12, the main injection command signal generating portion 2A, auxiliary injection command signal generating portion 2B and switching circuit 2C cooperate with each other to constitute an injection command signal generating section.

The signal source 1 is a signal generator including a rotor 101 mounted on a revolving shaft of the internal combustion engine and a signal generating element 102, wherein the rotor 101 includes a reluctor 101*a* arranged on an outer periphery of a rotator made of iron. The rotator for the rotor 101 may comprise a flywheel of a flywheel magnet rotating element mounted on the engine. The signal generating element 102 includes an iron core having a magnetic pole section arranged opposite to the rotor 101, a signal coil 1*a* wound on the iron core and a permanent magnet magnetically coupled to the iron core, as known in the art. A variation in magnetic flux occurring when the reluctor 101*a* starts to be opposite to the magnetic pole section of the iron core of the signal generating element 102 and such opposition of the reluctor 101*a* to the magnetic pole section of the iron core of the signal generating element 102 terminates causes pulse-like signals Vs1 and Vs2 to be generated on the signal coil 1*a*, respectively.

The main injection command signal generating portion 2A is realized by a microcomputer 200 driven by an output of the power circuit 3 and a predetermined software for operating the microcomputer and functions to operate fuel injection time based on an output of the signal source 1 and outputs of various sensors such as a throttle sensor for detecting a degree of opening of a throttle valve, a temperature sensor for detecting a temperature of air sucked, a pressure sensor for detecting an atmospheric pressure and the like which are inputted thereto, resulting in generating a main injection command signal Vj of a rectangular waveform at a fuel injection start position.

The auxiliary injection command signal generating portion 2B comprises a rectangular signal generating circuit 201 for generating a signal of a rectangular waveform such as a monostable multivibrator or the like and is adapted to be triggered to generate an auxiliary injection command signal Vj' of a rectangular waveform which has a predetermined time width, when the signal source 1 generates a predetermined signal.

The main injection command signal Vj and auxiliary injection command signal Vj' thus generated are then fed to the switching circuit 2C. A program for operating the microcomputer 200 has a check program for checking operation of the microcomputer according to a known procedure incorporated therein; so that when the microcomputer is under normal operation, it is permitted to generate a switching signal Ve of a high level, which is then fed to a control terminal of the switching circuit 2C. The switching circuit 2C comprises a relay or semiconductor switch and functions to feed a control terminal of the switch circuit 5 with an injection command signal Vjo during a period of time for which the microcomputer 200 is kept generating the main injection command signal Vj when the switching signal Ve is fed, to thereby turn on the switch circuit 5. The switching circuit 2C also feeds the control terminal of the switch circuit 5 with the injection command signal Vjo during a period of time for which the rectangular signal generating circuit 201 generates the injection command signal Vj'. The switch circuit 5 is kept turned on during a period of time for which it is fed with the injection command signal Vjo from the witching circuit 2C, so that a driving current Id may be fed from the power circuit 3 to the driving coil 4*a* of the injector 4. The injector 4 opens the valve when the driving current is increased to a predetermined level after it is fed thereto, resulting in carrying out injection of fuel into a fuel injection space of the engine. Normally, fuel is injected into a throttle body of the engine.

The power circuit 3 includes a generating coil 3*a* arranged in a magneto mounted on the internal combustion engine, a rectifier 3*b* and a power capacitor 3*c* charged through the rectifier 3*b* by means of an output of the generating coil 3*a*. A voltage Vc induced across the power capacitor 3*c* is applied to a power terminal of the microcomputer 200, across a series circuit of the driving coil 4*a* of the injector and the switch circuit 5, and to a power terminal of the rectangular signal generating circuit 201.

The fuel injection device generally requires a fuel pump for feeding fuel to the injector. The fuel pump is driven by means of an output of an additional generating coil provided on the magneto separately from the generating coil 3*a*. A pressure of fuel fed from the fuel pump to the injector is kept at a substantially constant level by a regulator.

The fuel injection device adapted to control fuel injection time by means of a microcomputer is disadvantageous in that a failure in normal operation of the microcomputer leads to a failure in operation of the engine. In particular, such a failure in operation of a microcomputer encountered during operation of an outboard motor, a snow mobile or the like brings on danger such as a failure in navigation, stalling in the snow or the like.

In view of the problem, the fuel injection device of FIG. 12 is provided with the auxiliary injection command signal generating portion 2B using a hardware circuit separately from the main injection command signal generating portion 2A using a microcomputer; so that when the microcomputer fails in normal operation, the injector may be driven by means of an injection command signal generated from the auxiliary injection command signal generating portion.

More particularly, in the fuel injection device of FIG. 12, the injector 4 is fed with a driving current during a period of time for which the microcomputer 200 generates the main injection command signal Vj when the microcomputer 200 is under normal operation, so that fuel injection time may be controlled by the microcomputer 200. When the microcomputer 200 fails to normally operate, the microcomputer stops generating the switching signal Ve, so that the switching circuit 2C feeds the switch circuit 5 with the injection command signal Vjo during a period of time for which the auxiliary injection command signal generating portion 2B generates the auxiliary injection command signal Vj'. Thus, in an emergency wherein the microcomputer fails in normal operation, the auxiliary injection command signal generating portion 2B functions to control fuel injection time.

As described above, when the injector 4 is driven by the power circuit 3 which uses, as a power supply therefor, the generating coil provided in the magneto mounted on the engine, charges in the power capacitor are discharged toward the injector during starting of the engine before charges in an amount required for driving the injector are accumulated in the power capacitor. This causes accumulation of charges required for driving the injector in the power capacitor to be delayed, resulting in much time being required for starting operation of the injector or opening the valve of the injector, leading to deterioration in starting characteristics of the engine.

Also, a fuel feed rate at which fuel is fed from the injector to the engine is determined by a product of a fuel feed pressure under which fuel is fed to the injector and fuel injection time for which the valve of the injector is kept open, whereas the fuel feed pressure is kept constant during operation of the engine. Thus, in driving of the injector, the fuel injection time is operated on the assumption that the fuel feed pressure is constant. However, driving of the fuel pump using the magneto as a power supply therefor requires much time to increase a discharge pressure of the fuel pump to a predetermined level after starting operation of the engine is started. Thus, driving of the injector for injection of fuel immediately after start of starting operation of the engine causes a fuel injection rate to be insufficient during initial injection of fuel. Substantial deficiency of the fuel injection rate during the initial fuel injection substantially affects starting characteristics of the engine as compared with some deficiency thereof.

SUMMARY OF THE INVENTION

The present invention has been made in view of the foregoing disadvantage of the prior art.

Accordingly, it is an object of the present invention to provide a method for driving an injector for an internal combustion engine which is capable of preventing start of operation of the injector from being delayed during starting of the engine, to thereby improve starting characteristics of the engine.

It is another object of the present invention to provide a method for driving an injector for an internal combustion engine which is capable of preventing substantial deficiency of a fuel feed rate during initial or first fuel injection.

In accordance with the present invention, a method for driving an injector for an internal combustion engine is provided. The method generally comprises the steps of providing a power circuit including a magneto driven by the internal combustion engine, a rectifying circuit for rectifying an output of the magneto and a power capacitor charged by means of an output of the rectifying circuit; applying a voltage induced across the power capacitor to a driving coil of the injector by means of the power circuit; obtaining information on an angle of rotation of the internal combustion engine and information on an engine speed based on a pulse signal obtained from a signal generator driven by the internal combustion engine, to thereby generate an injection command signal of a predetermined signal width; feeding a driving current from the power circuit to the driving coil while the injection command signal is generated, to thereby drive the injector.

The method of the present invention generally constructed as described above further comprises the steps of prohibiting driving of the injector during an injector drive prohibition period which is a predetermined period of time defined after start of starting operation of the internal combustion engine and permitting driving of the injector after a lapse of the injector drive prohibition period.

Such provision of the injector drive prohibition period during starting of the engine as described above permits charging of the power capacitor to be advanced during the starting, to thereby promote rising of the voltage across the power capacitor immediately after start of starting operation of the engine as compared with when feeding of the driving current to the injector is permitted immediately after start of starting operation of the engine, resulting in effectively preventing start of operation of the injector from being delayed. Also, it leads to an increase in discharge pressure of a fuel pump during the injector drive prohibition period, to thereby prevent a delay of starting operation of the injector due to a delay of charging of the power capacitor, as well as deficiency of an initial fuel feed rate.

The injector drive prohibition period, for the purpose of preventing a delay of starting operation of the injector, may be a period of time defined so as to permit charges in an amount required for driving the injector to be accumulated in the power capacitor after starting operation of the internal combustion engine is started. Alternatively, when it is important to prevent deficiency of a fuel injection rate during initial fuel injection, the injector drive prohibition period may be a period of time defined so as to permit a pressure of fuel fed to the injector to be increased to a predetermined level after start of starting operation of the internal combustion engine.

Further, when it is desired to prevent both a delay of starting operation of the injector and deficiency of a fuel injection rate during initial fuel injection, the injector drive prohibition period may be longer one of a period of time defined so as to permit charges in an amount required for driving the injector to be accumulated in the power capacitor after start of starting operation of the internal combustion engine and a period of time defined so as to permit a pressure of fuel fed to the injector to be increased to a predetermined level after start of starting operation of the internal combustion engine.

A lapse of the injector drive prohibition period may be detected in various ways.

For example, a lapse of the injector drive prohibition period may be detected when the voltage across the power capacitor reaches a predetermined level. The voltage across the power capacitor is proportional to the amount of charges accumulated in the power capacitor, so that detection of the voltage across the power capacitor permits accumulation of charges in an amount required for driving the injector in the power capacitor to be appropriately detected.

A period of time required for permitting the injector to be driven after start of starting operation of the engine and that required for permitting a fuel feed pressure to be increased to a predetermined level are generally within a certain range, although they somewhat depend on skill of an operator who carries out the starting operation. Thus, a lapse of the injector drive prohibition period may be detected on the basis of the number of times of generation of the pulse signal from the signal generator after start of starting operation of the internal combustion engine. In this instance, a lapse of the injector drive prohibition period may be detected when counting of a series of pulses generated from the signal generator indicates that the number of the pulses reaches a set value. Alternatively, detection of the lapse may be carried out on the basis of a particular part of a plurality of pulses generated from the signal generator. More specifically, the lapse may be detected when generation of the particular part of the pulses is carried out a predetermined number of times.

In general, intervals at which the signal generator generates a pulse signal are not uniform, therefore, it is impossible to previously know the type of a pulse initially generated during starting operation of the engine. Thus, when a lapse of the injector drive prohibition period is detected on the basis of the number of times of generation of the pulse from the signal generator, the injector drive prohibition period is caused to be somewhat varied every time when starting operation of the engine is carried out. However, such a variation of the injector drive prohibition period does not substantially adversely affect the detection.

Detection of a lapse of the injector drive prohibition period is not limited to the above-described ways. For example, a lapse of the injection drive prohibition period may be judged when an output of the magneto, an engine speed or a lapse of time after start of starting operation of the engine reaches a predetermined level. Also, the lapse may be judged when the amount of charges accumulated in the power capacitor which is detected by subjecting a charging current of the power capacitor detected to an operation for integration reaches a predetermined level.

Prohibition of flowing of the driving current through the injector during the injector drive prohibition period is accomplished by any suitable way such as prohibition of generation of the injection command signal during the injector drive prohibition period, prohibition of feeding of the injection command signal to the switch circuit while permitting generation of the injection command signal, interposition of a switch means between the power capacitor and the driving coil of the injector to keep the switch means interrupted during the injector drive prohibition period, or the like.

In the present invention, the injection command signal may be generated in any desired manner. For example, the injection command signal may be generated from any one of a first injection command signal generating portion using a microcomputer and a second injection command signal generating portion using a hardware circuit. Alternatively, only any one of the first and second injection command signal generating portion may be provided to generate the injection command signal.

In the present invention, the power circuit is merely required to include at least the generating coil of the magneto, the rectifier and the power capacitor. It may further include a voltage control circuit which functions to limit the voltage across the power capacitor to a predetermined level, and the like.

In general, when a driving current is initially fed to the driving coil of the injector during starting of the internal combustion engine, charges in the power capacitor are discharged toward the injector before a sufficient amount of charges are accumulated in the power capacitor, resulting in charging of the power capacitor being delayed, so that start of operation of the injector is delayed.

On the contrary, the above-described construction of the present invention that the injector drive prohibition period is provided for prohibiting driving of the injector after start of starting operation of the internal combustion engine permits charging of the power capacitor to be promoted during the period, resulting in advancing rising of the voltage across the power capacitor as compared with when the driving current is permitted to flow through the injector immediately after start of starting operation of the engine, so that start of operation of the injector may be prevented from being delayed. Also, such construction of the present invention permits a discharge pressure of the fuel pump to be increased during the injector drive prohibition period, to thereby prevent deficiency of a fuel injection rate during initial fuel injection.

An output of the power circuit is fed to the injection command signal generating portion as well. The injection command signal generating portion is constituted by an electronic circuit irrespective of either a microcomputer or a hardware circuit which is used for the injection command signal generating portion. Thus, the injection command signal generating portion does not provide any increased load on the power circuit, so that driving of the injection command signal generating portion does not disadvantageously contribute to a delay of rising of an output of the power circuit.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 6 is a graphical representation showing a waveform of a driving current of an injector obtained when the driving current is slowly swept;

FIG. 7(A) is a waveform chart showing a waveform of an injection command signal;

FIG. 7(B) is a waveform chart showing a waveform of a driving current of an injector;

FIG. 8 is a graphical representation showing a variation of an engine speed and a voltage across a power capacitor with time which was actually measured in an embodiment of a method for driving an injector for an internal combustion engine according to the present invention;

FIG. 9 is a graphical representation showing a variation of an engine speed and a voltage across a power capacitor with time which was actually measured in a conventional injector driving device;

FIG. 10(A) is a waveform chart showing a waveform of an injection command signal;

FIG. 10(B) is a waveform chart showing a waveform of a driving current obtained by varying a voltage across a power capacitor;

DETAILED DESCRIPTION OF THE PREFERRED EMBODIMENTS

Now, a method for driving an injector for an internal combustion engine according to the present invention will be described hereinafter with reference to the accompanying drawings.

Figure 1:
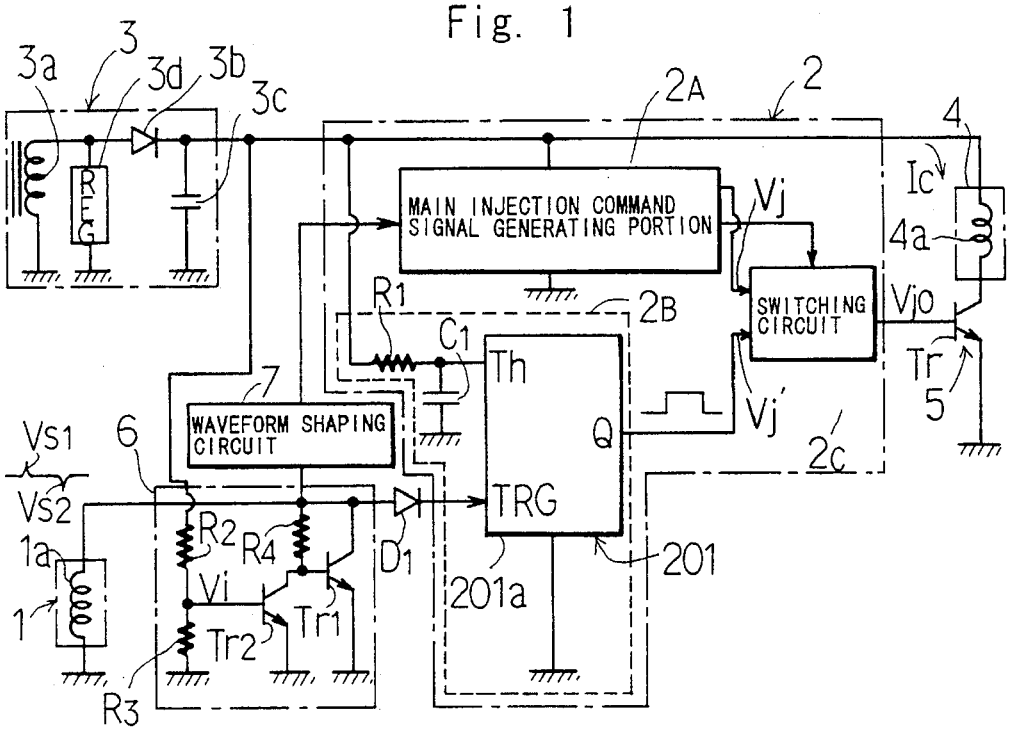
FIG. 1 is a circuit diagram showing an example of an injector driving device used for practicing a method of the present invention.
Figure 12:
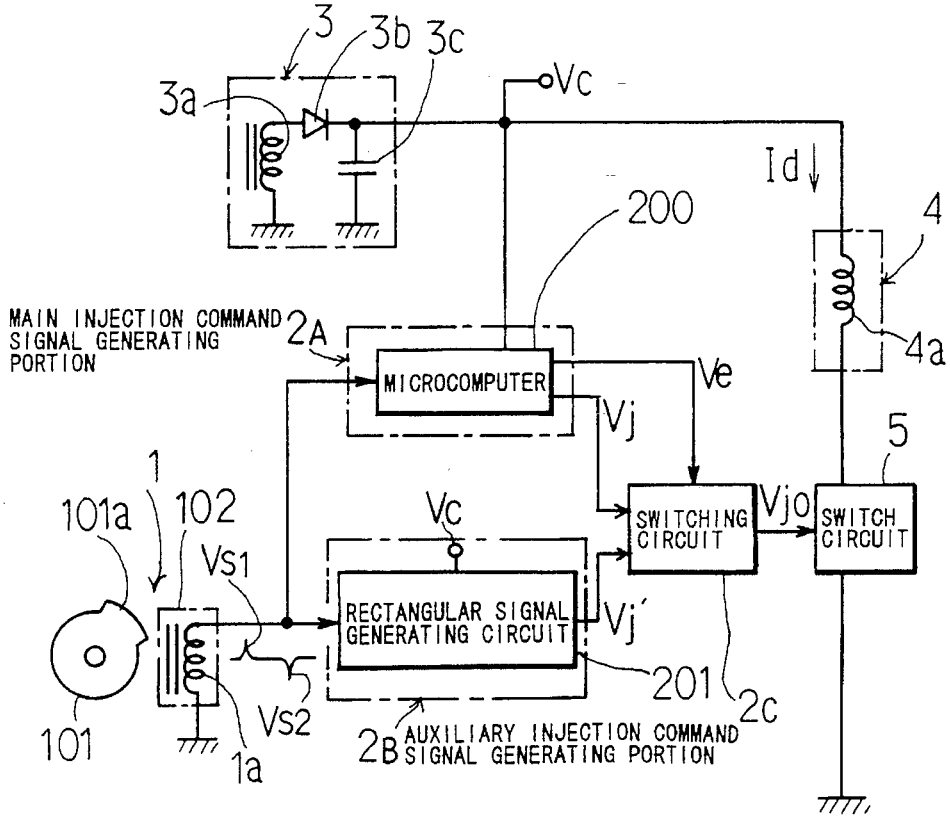
FIG. 12 is a circuit diagram showing a conventional injector driving device previously proposed by the assignee.

Referring first to FIG. 1, an injector driving device which is adapted to be used for practicing a method of the present invention is illustrated by way of example. In FIG. 1, reference numeral 1 designates a signal generator which may be constructed in substantially the same manner as that in the prior art described above with reference to FIG. 12. 2 is an injection command signal generating section including a main injection command signal generating portion 2A, an auxiliary injection command signal generating portion 2B and a switching circuit 2C. 3 is a power circuit including a generating coil 3*a* provided in a magneto mounted on an internal combustion engine, a rectifier 3*b* for rectifying an output of the generating coil 3*a*, a power capacitor 3*c* charged by means of an output of the rectifier 3*b*, and a voltage control circuit 3*d* for limiting a voltage Vc across the power capacitor 3*c* to a predetermined level. 5 is a switch circuit comprising a transistor Tr, 6 is a means for controlling a driving current during starting (hereinafter referred to as "start-time driving current control means") which functions to control feed of a driving current to a driving coil 4*a* of an injector 4 during starting of the engine, and 7 is a waveform shaping circuit for converting an output of the signal generator 1 into a signal of a predetermined waveform and then feeding the main injection command signal generating portion 2A with the signal.

The voltage Vc across the power capacitor 3*c* is applied across a series circuit comprising the driving coil 4*a* of the injector 4 and a collector-emitter circuit of the transistor Tr constituting the switch circuit 5, as well as to a power terminal of the injection command signal generating section 2. A base of the transistor Tr is fed with an injection command signal Vjo from the main injection command signal generating portion 2A or auxiliary injection command signal generating portion 2B of the injection command signal generating section 2 through the switching circuit 2C of the section 2.

In the illustrated embodiment, the main injection command signal generating portion 2A comprises a microcomputer and the auxiliary injection command signal generating portion 2B comprises a rectangular wave signal generating circuit 201 including an IC 201*a* of a monostable multivibrator as well as a resistor R1 and a capacitor C1 each for signal adjustment, wherein a pulse signal Vs1 generated from the signal generator 1 is fed through a diode D1 to a trigger terminal TRG of the IC 201*a*. The IC 201*a* outputs, in the form of an auxiliary injection command signal Vj', a rectangular wave signal of a signal width determined by the resistor R1 and capacitor C1 every time when the pulse signal Vs1 is fed thereto. The signal generator 1 is provided so as to permit a position of generation of the pulse signal Vs1 to be suitable as a position at which injection of fuel is started.

In the embodiment shown in FIG. 1, a circuit for adjusting a signal width of the auxiliary injection command signal Vj' is provided, which comprises the single resistor R1 and single capacitor C1. Alternatively, it may further comprise a temperature sensing resistive element and/or a circuit for carrying out changing-over between a signal width of the signal Vj' during starting operation of the engine and that during normal operation thereof for the purpose of temperature compensation.

A fuel pump (not shown) is arranged, which is driven by a generating coil provided in the magneto for pump driving. Fuel is fed from the fuel pump to the injector 4. The injector 4 is provided with a fuel inlet port to which a pressure regulator is connected, so that when a pressure of fuel fed to the injector 4 exceeds a predetermined level, the pressure regulator causes a part of fuel fed from the fuel pump to the injector to escape to a fuel tank, to thereby keep the fuel feed pressure to a predetermined level.

In the injector driving device shown in FIG. 1, when starting operation of the internal combustion engine is started, the magneto mounted on the engine is rotated to induce an AC voltage across the generating coil 3*a*, so that the AC voltage is applied across the power capacitor 3*c* while being rectified by the rectifier 3*b*. When an injection command signal Vjo is fed to the transistor Tr, it is turned on, to thereby permit a driving current Ic to flow from the power capacitor 3*c* through the driving coil 4*a* of the injector and the collector-emitter circuit of the transistor Tr.

In the injector driving method of the present invention, an injector drive prohibition period is provided during starting of the internal combustion engine, to thereby prohibit driving of the injector during the injector drive prohibition period after start of starting operation of the engine and permit a driving current to be fed to the injector after the injector drive prohibition period. During prohibition of driving of the injector, charging of the power capacitor is promoted and an increase in fuel feed pressure to a predetermined level is accomplished.

In the embodiment shown in FIG. 1, a period necessary for the power capacitor to be charged to a level required to drive the injector 4 after starting operation of the internal combustion engine is started is defined to be the injector drive prohibition period, resulting in permitting a driving current to be fed to the driving coil 4*a* of the injector 4 after the power capacitor 3*c* is charged to the predetermined level. Thus, for the purpose of controlling feed of a driving current to the injector during starting of the engine, the start-time driving current control means 6 described above is arranged.

In the embodiment of FIG. 1, the start-time driving current control means 6 includes a series circuit of resistors R2 and R3 connected across the power capacitor 3*c*, a transistor Tr1 of which a collector-emitter circuit is connected in parallel to the signal coil 1*a*, a transistor Tr2 of which a collector-emitter circuit is connected in parallel between a base of the transistor Tr1 and an emitter thereof, and a resistor R4 connected between a collector of the transistor Tr1 and the base thereof. The series circuit of the resistor R2 and R3 acts as a voltage dividing circuit constituting a voltage detection circuit. For this purpose, a series combined resistance of the resistors R2 and R3 is set to a sufficiently increased level.

In the illustrated embodiment, the resistors R2 and R3 cooperate with each other to constitute a means for detecting time at which driving of the injector is started (hereinafter referred to as "injector drive start time detection means"). The injection drive start time detection means functions to detect the voltage Vc across the power capacitor 3*c* to detect charges accumulated in the power capacitor 3*c*, to thereby output an injector drive start signal Vi of a predetermined magnitude or a magnitude required to turn on the transistor Tr2 when accumulation of charges in an amount required for driving the injector in the power capacitor is detected.

Also, in the embodiment of FIG. 1, the transistors Tr1 and Tr2 and resistor R4 cooperate together to constitute the start-time driving current control means. The start-time driving current control means prevents the injection command signal Vj' from being outputted until the injector drive start signal Vi is outputted, to thereby prohibit a driving current from flowing through the driving coil 4*a* of the injector 4 and permits generation of the injection command signal Vj' after the injector drive start signal Vi is outputted, to thereby allow the driving current to flow through the driving coil.

In the embodiment of FIG. 1, when charges accumulated in the power capacitor 3*c* after the starting operation is started is insufficient to permit the voltage Vc across the power capacitor 3*c* to reach a predetermined level, a voltage across the resistor R3 is decreased to keep the transistor Tr2 turned off, so that the transistor Tr1 is turned on every time when the signal generator 1 generates the pulse signal Vs1 to cause the pulse signal to be by-passed from the trigger terminal of the IC 201*a*. Thus, the IC 201*a* is not fed with a trigger signal during the injector drive prohibition period or until the voltage across the power capacitor 3*c* increased to the predetermined level, so that the rectangular wave signal generating circuit 201 does not generate the auxiliary injection command signal Vj'.

The microcomputer constituting the main injection command signal generating portion 2A is adapted to detect the voltage Vc across the power capacitor 3*c* and keeps from generating the main injection command signal Vj when the voltage is below the predetermined level.

Thus, the transistor Tr is kept from being fed with the injection command signal Vjo until charges accumulated in the power capacitor 3*c* during starting of the engine are increased to a predetermined level, to thereby keep the transistor turned off.

When the power capacitor 3*c* is charged in an amount required to permit the voltage Vc across the power capacitor 3*c* to be increased to the predetermined level, the transistor Tr2 is turned on and the transistor Tr1 is turned off, so that the IC 201*a* may be fed with a trigger signal from the signal generator 1. Thus, the rectangular wave signal generating circuit 201 generates the auxiliary injection command signal Vj' every time when the signal generator 1 generates the pulse signal Vs1. Also, when the voltage Vc across the power capacitor 3*c* is increased to the predetermined level or more, the main injection command signal generating portion 2A is permitted to generate the main injection command signal Vj.

Thus, after the power capacitor 3*c* is charged in a required or predetermined amount or the injector drive prohibition period elapses, the transistor Tr is fed with the injection command signal Vjo at each of injection start positions, during which the transistor Tr is kept turned on to flow the driving current Ic through the driving coil 4*a* of the injector 4. The injector 4 includes a valve rendered open when the driving current is increased to a predetermined trigger level $I_{on}$ and closed when it decreased to a predetermined cut-off level $I_{off}$ or below.

FIG. 6 shows a waveform of the driving current Ic flowing through the driving coil 4*a* of the injector 4, which was obtained when the current is slowly swept. The valve of the injector 4 is rendered open when the current is increased to the trigger level $I_{on}$ and closed when it is reduced to the cut-off level $I_{off}$. In general, there is established relationship of $I_{on}>I_{off}$ and $I_{on}$ is about twice as large as $I_{off}$.

FIGS. 7(A) and 7(B) each show a waveform of the driving current Ic flowing through the driving coil 4*a* of the injector 4 when the transistor Tr is fed with the injection command signal Vjo. When the injection command signal Vjo is fed to the transistor Tr constituting the switch circuit 5 at time $t_o$ to turn on it, the driving current Ic is increased, resulting in reaching the trigger level $I_{on}$ at time $t_{on}$, so that the valve of the injector 4 is rendered open to start injection of fuel. This results in ineffective time ($t_{on}-t_o$) of a predetermined length being defined between the apparent injection start time $t_o$ at which the injection command signal Vj is fed and the time $t_{on}$ at which fuel injection is actually started. The driving current reaches a peak value after an inclination of increase of the driving current is reduced at a position of the trigger level $I_{on}$ and then is decreased to a holding level $I_{hold}$ required for holding the valve of the injector 4 open. When the injection command signal Vjo is extinguished at time $t_{off}$ to turn off the transistor Tr, the driving current Ic is rendered zero, to thereby cause the valve of the injector 4 to be closed. Actual fuel injection time (effective time) is between the time $t_{on}$ and the time $t_{off}$.

Figure 4:
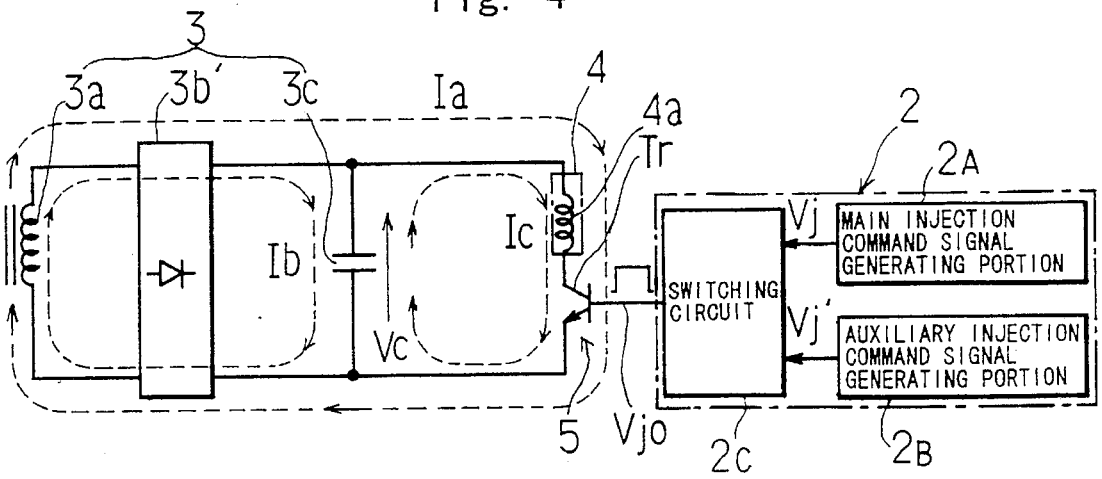
FIG. 4 is a circuit diagram showing operation of a power circuit in an embodiment of a method for driving an injector for an internal combustion engine according tot he present invention.

Now, the manner of operation of the power circuit which uses the power circuit 3 as a power supply therefor to feed the injector 4 with the driving current Ic by means of an output thereof will be described hereinafter while determining requirements which the voltage Vc across the power capacitor 3*c* should satisfy in order to operate the injector. In the following description, as shown in FIG. 4, currents Ia to Ic at the respective parts are determined and the voltage across the power capacitor 3*c* is indicated as Vc. Also, in FIG. 4, reference character 3*b'* indicates a rectifying circuit constructed in any desired manner and the voltage control circuit may be understood to be contained in the rectifying circuit.

Also, the following description will be made on the assumption that output voltage (V)-to-load current (I) characteristics of the magneto obtained at a certain engine speed during starting of the internal combustion engine are as indicated at a curve a in FIG. 5 and a load straight line of the injector 4 is as indicated at a straight line b in FIG. 5.

Figure 5:
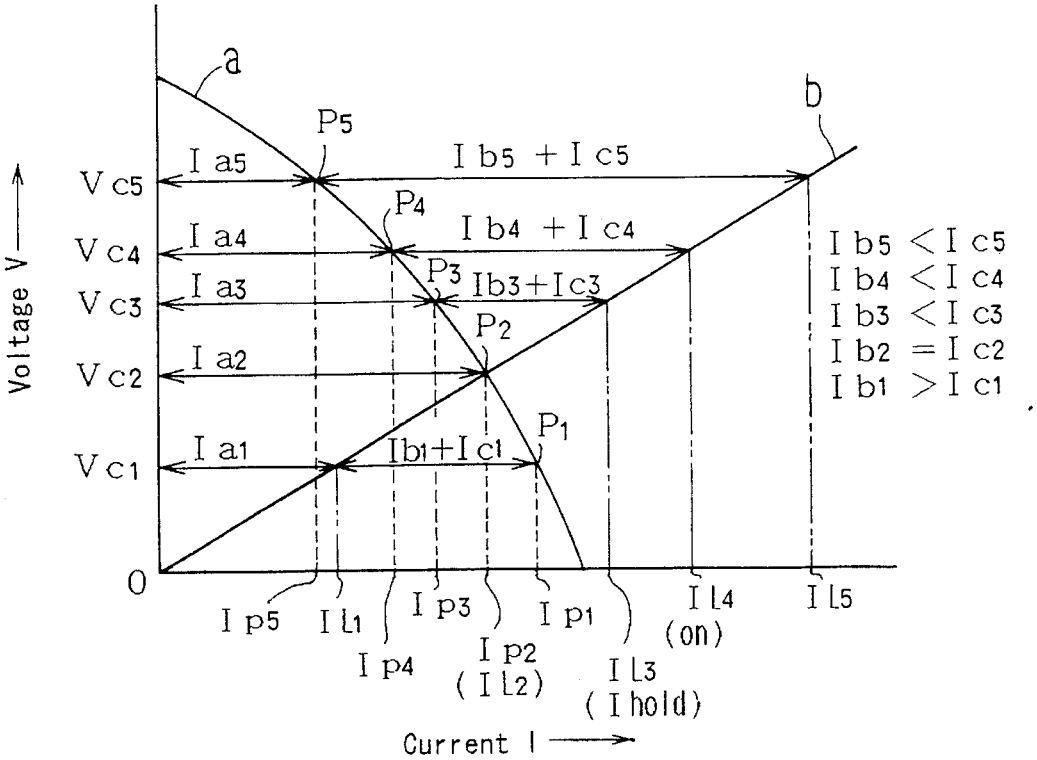
FIG. 5 is a graphical representation showing output voltage-to-load current characteristics of a magneto and a load straight line thereof.

In FIG. 5, Ip1 to Ip5 on an axis of abscissas each indicate a current at operation points P1 to P5 on a V-I curve of the generator and $I_{L1}$ to $I_{L5}$ each indicate a current flowing through the driving coil 4*a* of the injector 4 at each of the operation points P1 to P5. Also, Vc1 to Vc5 on an axis of ordinates each indicate the voltage Vc across the power capacitor 3*c* corresponding to each of the operation points P1 to P5 and I1 to Ia5 each indicate the current Ia (FIG. 4) corresponding to each of the operation points P1 to P5. Further, Ib1 to Ib5 each indicate the current Ib corresponding to each of the operation points P1 to P5 and Ic1 to Ic5 each indicate the current Ic corresponding to each of the operation points P1 to P5.

In the example shown in FIG. 5, the voltage Vc across the power capacitor 3*c* obtained while a driving current of the trigger level $I_{on}$ ($=I_{L4}$) flows through the driving coil of the injector is indicated to be Vc4 and the voltage Vc across the power capacitor 3*c* while a driving current of the holding level $I_{hold}$ ($=I_{L3}$) flows through the driving coil is indicated to be Vc3.

In FIG. 5, supposing that the transistor Tr is turned on when the voltage Vc across the power capacitor 3*c* is kept at the level Vc1, the current Ia1 is caused to flow through the driving coil 4*a* of the injector 4. At this time, the magneto is permitted to feed the current Ip1, which is smaller than the current Ia1 (Ip1<Ia1), so that the power capacitor 3*c* may be charged with a current Ip1−Ia1=Ib1+Ic1. However, this fails to permit a current of the trigger level $I_{on}$ to flow through the driving coil 4*a* of the injector 4, resulting in the valve of the injector 4 being kept closed.

Supposing that the transistor Tr is turned on when the voltage Vc across the power capacitor is at the level Vc2, the current Ia2 is permitted to flow through the driving coil 4*a* of the injector 4. At this time, the magneto is permitted to feed the current Ip2 (=Ia2), so that the power capacitor 3*c* is kept from charge and discharge. This likewise fails to permit the driving current of the injector to reach the trigger level, to thereby keep the valve of the injector closed.

Then, supposing that the transistor Tr is turned on when the voltage Vc across the power capacitor 3*c* is at the level Vc3, so that the driving current is permitted to flow the driving coil 4*a* of the injector 4; the current IL3 is permitted to flow the driving coil 4*a* of the injector 4. At this time, the magneto is permitted to feed only the current Ip3, resulting in a discharge current Ib3+Ic3 flowing from the power capacitor 3*c* to the driving coil of the injector. This likewise fails to permit a current of the trigger level $I_{on}$ or more to flow through the driving coil of the injector, so that the valve of the injector is kept from being open.

Also, when the transistor Tr is turned on when the voltage Vc across the power capacitor is at the level Vc4, the current Ia4 is permitted to flow from the magneto to the driving coil 4*a* of the injector 4 and a discharge current Ib4+Ic4 is permitted to flow from the power capacitor 3*c* to the driving coil of the injector, so that the injector is fed with the driving current $I_{L4}$ equal to the trigger level $I_{on}$. In order that an injection command signal initially fed to the injector during starting of the engine renders the valve of the injector open, it is required that the voltage Vc across the power capacitor 3*c* at the time $t_{on}$ is at the level Vc4 or more, therefore, the power capacitor 3*c* is charged to a level beyond the voltage Vc4 at the time $t_o$. When the voltage Vc across the power capacitor 3*c* at the time $t_o$, an electrostatic capacitance thereof at the time $t_o$ and the amount of charges used between the time $t_o$ and the time $t_{on}$ are represented by Vc5, C and q1, respectively, the voltage Vc5 is required to satisfy at least relationship C(Vc5−Vc4)≧q1 at the time $t_o$ in order to open the valve of the injector. Thus, opening of the valve of the injector requires that the voltage Vc5 across the power capacitor satisfies the following relationship at the time $t_o$:

$$Vc5 \geqq (q1/C)+Vc4 \quad (1)$$

The amount of charges q1 used between the time $t_o$ and the time $t_{on}$ can be obtained by integration of $q=\int i(t)dt$ over an integration section of from $t_o$ to $t_{on}$ supposing that a current at each of times in FIG. 7 is i(t).

Also, in order to keep the valve of the injector 4 open until the time $t_{off}$ at which the injection command signal is extinguished, it is required to permit the holding current $I_{hold}$ exceeding the cutoff level $I_{off}$ to flow between the time $t_{on}$ and the time $t_{off}$ and keep the voltage Vc across the power capacitor at the level Vc3 or more at the time $t_{off}$. Where the voltage Vc across the power capacitor when the valve of the injector is open at the time $t_{on}$ is indicated at Vcon (≧Vc4) and the amount of charged used between the time $t_{on}$ and the $t_{off}$ is indicated at q2, the voltage Vcon is required to satisfy relationship C(Vcon−Vc3)≧q2. Thus, the voltage Vcon across the power capacitor at the time $t_{on}$ is required to satisfy the following relationship:

$$Vcon \geqq (q2/C)+Vc3 \quad (2)$$

Supposing that Vcon is equal to Vc4 (Vcon=Vc4) in view of the possible limit; in order to keep the valve of the injector open until the injection command signal is extinguished, the voltage Vc5 across the power capacitor 3*c* is required to satisfy the following relationship:

$$Vc5 \geqq (q1/C)+(q2/C)+Vc3=Vcs \quad (3)$$

The amount of charges q2 used between the time $t_{on}$ and the time $t_{off}$ can be obtained by integration of $q=\int i(t)dt$ over an integration section of from $t_{on}$ to $t_{off}$.

Thus, when Vcs described above is set to be the voltage Vc across the power capacitor 3*c* and flowing of the driving current through the driving coil 4*a* of the injector 4 is prohibited during the injector drive prohibition period for which the voltage Vc across the power capacitor 3*c* is below the set value Vcs, the power capacitor 3*c* may be charged in an amount sufficient to drive the injector, therefore, it is possible to initially fully operate the valve of the injector depending on the injection command signal.

Also, provision of the injector drive prohibition period during starting of the engine leads to an increase in discharge pressure of the fuel pump (not shown in FIG. 1) during the period, to thereby prevent deficiency of a fuel feed pressure during initial fuel injection.

FIGS. 10(A) and 10(B) show waveforms of the driving current Ic obtained when generating the injection command signal Vjo while varying the voltage Vc across the power capacitor 3*c*, wherein a indicates a waveform of the current obtained when the voltage Vc across the power capacitor satisfies the above-described expression (3) at the time $t_o$. Also, b indicates a waveform of the current obtained when the voltage Vc across the power capacitor is in a range of Vc3<Vc<Vc4 at the time $t_o$ and c indicates a waveform of the current obtained when the voltage Vc across the power capacitor is in a range of Vc<Vc3 at the time $t_o$.

When the driving current is flowed through the driving coil of the injector while limiting the voltage Vc across the power capacitor below a value set as seen in the waveforms b and c of FIG. 10, the injector acts as a load for the power circuit, to thereby delay rising of an output voltage thereof and the valve of the injector is kept from being open, resulting in starting of the engine being delayed.

FIG. 9 shows a variation, with time, of both the voltage Vc across the power capacitor and the engine speed N each based on a value actually measured, as well as the injection command signal Vjo, which variation was obtained when the transistor Tr of FIG. 1 is fed with the injection command signal Vjo while keeping the voltage Vc across the power capacitor insufficiently increased, to thereby cause the driving current to flow through the driving coil of the injector 4.

FIG. 8 shows a variation, with time, of both the voltage Vc across the power capacitor and the engine speed N each based on a value actually measured, as well as the injection command signal Vjo, which variation was obtained when the transistor Tr of FIG. 1 is fed with the injection command signal Vjo at the time $t_o$ to flow the driving current through the driving coil 4*a* of the injector 4 after the voltage Vc across the power capacitor was increased to the set value Vcs or more at the time $t_s$.

As will be noted from FIGS. 8 and 9, the construction of generating the injection command signal Vjo to flow the driving current through the injector after the voltage Vc across the power capacitor exceeds the set value Vcs subsequent to start of the starting operation permits rising of the voltage Vc across the power capacitor and rising of the engine speed to be advanced as compared with the construction of generating the injection command signal Vjo to flow the driving current through the injector while keeping the voltage Vc across the power capacitor below the set level.

An experiment by the inventor revealed that even under severe conditions under which starting of the engine is carried out by recoil starting, prohibition of the injection operation when the injection command signal is initially generated after the starting operation substantially prevents both deficiency of an output voltage of the power circuit and deficiency of the fuel feed pressure.

The illustrated embodiment is constructed so as to permit the driving current to flow through the injector when the voltage Vc across the power capacitor satisfies the above-described expression (3). In this respect, when first injection of fuel is carried out during starting of the engine, it is merely required to keep the valve of the injector open for a certain length of time and it is not necessarily required to keep it open until the injection command signal is extinguished. Thus, the embodiment may be alternatively constructed so as to permit the driving current to flow through the injector at the time when it is detected that the voltage Vc across the power capacitor is increased to a level sufficient to satisfy the above-described expression (1).

Also, the illustrated embodiment is constructed so as to detect the voltage Vc across the power capacitor 3*c*, to thereby detect whether or not charges are accumulated in the power capacitor in a required amount, resulting in setting the injector drive prohibition period. In this regard, there exists certain relationship between the voltage Vc across the power capacitor and an output voltage of the generator and the output voltage depends on the engine speed. Therefore, detection of the engine speed N for detecting that the engine speed N reaches a predetermined set level Ns likewise permits accumulation of a required amount of charges in the power capacitor to be effectively detected. Thus, the object of the present invention may be likewise accomplished by detecting the engine speed to employ a length of time required for the engine speed to reach the set level as the injector drive prohibition period.

The embodiment shown in FIG. 1 is constructed so as to keep the injection command signal Vjo from being generated during the injector drive prohibition period, to thereby prohibit flowing of the driving current through the injector. Alternatively, the present invention may be constructed so as to prevent the voltage Vc across the power capacitor from being applied to the driving coil of the injector during the injector drive prohibition period.

Figure 2:
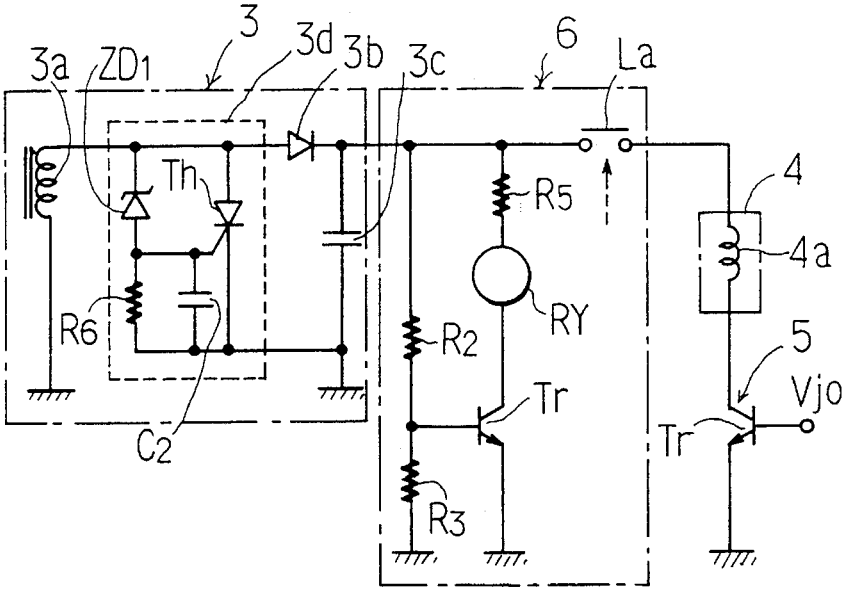
FIG. 2 is a circuit diagram showing another example of an injector driving device used for practicing a method of the present invention.

Referring now to FIG. 2, a second embodiment of the present invention is illustrated, which is constructed so as to keep a voltage across a power capacitor from being applied to a driving coil of an injector during a period of time which permits charges in an amount required for driving the injector to be accumulated in the power capacitor. For this purpose, in the second embodiment, an exciting coil RY of a relay is connected at one end thereof through a resistor R5 to a non-grounded terminal of a power capacitor 3*c* and connected at the other end thereof to a collector of a transistor Tr3 of which an emitter is grounded. The relay includes a normally open contact La, which is interposed between the power capacitor 3*c* and a driving coil 4*a* of an injector 4.

Also, in the illustrated embodiment, a voltage control circuit 3*d* is provided for restricting a voltage across the power capacitor 3*c* to a predetermined level or below. The voltage control circuit includes a thyristor Th, a Zener diode ZD1, a resistor R6 and a capacitor C2. In the voltage control circuit thus constructed, when the voltage across the power capacitor exceeds a predetermined set level, the Zener diode ZD1 is turned on to feed the thyristor Th with a trigger signal, to thereby render the thyristor Th conductive. Such turning-on of the thyristor Th prevents the capacitor 3*c* from being charged, so that the voltage across the capacitor 3*c* is limited to the predetermined level or less. Thus, the illustrated embodiment is constructed so as to permit generation of an injection command signal Vjo to be started at the time when the voltage across the power capacitor 3*c* reaches the predetermined level to render an injection command signal generating section ready for operation.

In the embodiment of FIG. 2, as noted from the above, when the voltage across the power capacitor 3*c* is below the predetermined level, the transistor Tr3 is turned off to keep the relay RY non-excited. Thus, the contact La of the relay is kept open, to thereby prevent application of a voltage to the driving coil 4*a* of the injector 4. This results in establishment of a voltage of a generator and charging of the power capacitor 3*c* being rapidly carried out. When the amount of charges accumulated in the power capacitor 3*c* reaches a set level to cause the voltage across the power capacitor to be increased to the predetermined level described above, the transistor Tr3 is turned on to cause the relay RY to be excited, leading to closing of the contact La. This permits the voltage across the power capacitor to be applied to the driving coil 4*a* of the injector 4, so that a driving current may be fed to the injector.

The remaining part of the second embodiment may be constructed in substantially the same manner as the first embodiment described above with reference to FIG. 1.

The above-described embodiments each are constructed so as to detect the voltage across the power capacitor, to thereby detect whether or not a predetermined or required amount of charges are accumulated in the power capacitor. Alternatively, each of the embodiments may be constructed so as to detect a voltage across the generating coil 3*a* of the magneto or a voltage across an additional generating coil arranged in the magneto, to thereby detect such accumulation of charges in the power capacitor. Also, the embodiments may be constructed so as to detect the engine speed based on an output level or output frequency of the magneto or signal generator, to thereby take an increase in engine speed to the predetermined level as a basis for judgment as to whether a required amount of charges are accumulated in the power capacitor. Further, they may be constructed in a manner to activate a timer when starting operation of the engine is initiated, to thereby judge that accumulation of charges in the power capacitor to a required level is accomplished at the time when the timer measures a predetermined length of period.

Figure 3:
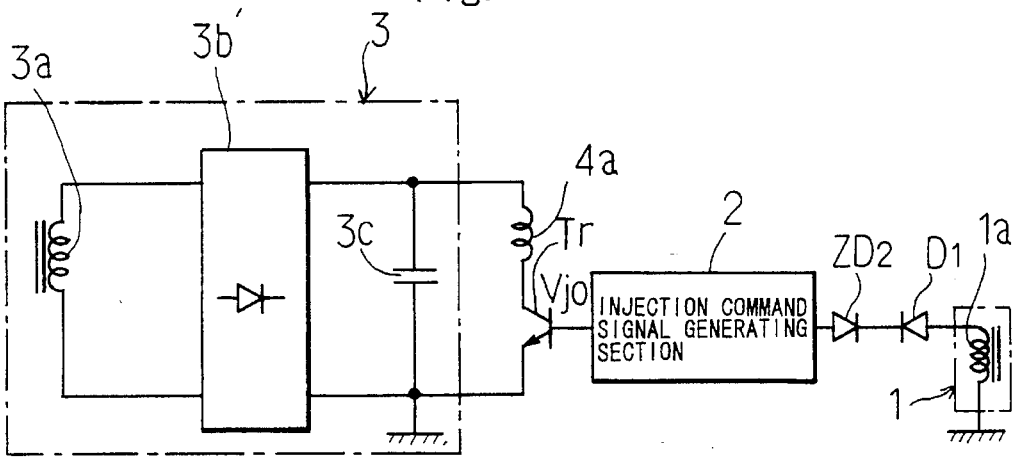
FIG. 3 is a circuit diagram showing a further example of an injector driving device used for practicing a method of the present invention.

Referring now to FIG. 3, a third embodiment of the present invention is illustrated, which is adapted to detect accumulation of a required amount of charges in a power capacitor while taking notice of the fact that during starting of an internal combustion engine, an output level of a signal generator is increased with an increase in an engine speed. For this purpose, the third embodiment is constructed in such a manner that a diode D1 and a Zener diode ZD2 are interposedly arranged between a signal coil 1*a* and an injection command signal generating section 2. When an engine speed is kept low, a crest value of a pulse signal induced across on the signal coil 1*a* is low as compared with that of a Zener voltage of the Zener diode ZD2, to thereby fail to feed the injection command signal generating section 2 with a signal, resulting in keeping an injection command signal Vjo from being generated.

Figure 11:
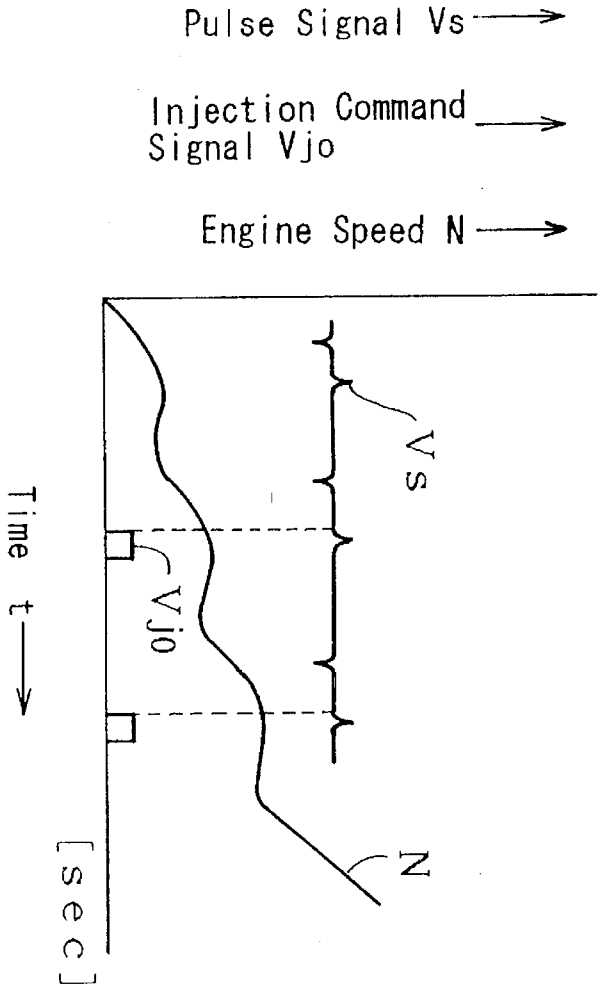
FIG. 11 is a graphical representation showing a variation of signal waveforms and an engine speed obtained when an injector drive prohibition period is detected from the number of times of generation of an output pulse from a signal generator in an embodiment of the present invention.

The embodiment of FIG. 3 is adapted to detect a lapse of an injector drive prohibition period based on an output level of a signal generator. Alternatively, a lapse of the injector drive prohibition period may be detected on the basis of the number of times of generation of an output pulse from the signal generator. FIG. 11 shows an example of a construction directed to such detection. In the example of FIG. 11, an injection command signal generating section is constructed so as to generate an injection command signal Vjo when a signal generator generates a pulse signal Vs of a positive polarity during starting of an internal combustion engine and keep the injection command signal Vjo from being generated on the basis of a pulse signal of a positive polarity first generated after a starting operation of the engine is initiated at time 0, that is, a pulse signal generated during first rotation of the engine. Thus, in the example, a lapse of the injector drive prohibition period is detected when a second positive-polarity signal is generated, so that first or initial fuel injection is carried out when the second positive-polarity signal is generated.

When detection of a lapse of the injector drive prohibition period is based on the number of times of generation of the output pulse signal from the signal generator, counting of the pulse signals may be carried out in any desired manner. For example, all pulse signals (pulse signals of positive and negative polarities) generated by the signal generator may be counted. Alternatively, only the number of times of generation of a particular pulse signal (any one of pulse signals of positive and negative polarities in the example of FIG. 11) may be counted.

In order to discriminate cylinders of a multi-cylinder internal combustion engine to which a series of pulse signals generated from the signal generator are to be applied, a pulse signal for a particular part of the cylinders may be constructed so as to be different in generation pattern from that for the remaining cylinders. For example, in connection with the particular part of the cylinders, a pulse signal of a positive polarity is successively generated twice and then a pulse signal of a negative polarity is generated; whereas in connection with the remaining cylinders, pulse signals of positive and negative polarities are alternately generated. In such a case, a lapse of the injector drive prohibition period may be detected on the basis of the number of times of generation of a specific pulse signal different in generation pattern from another pulse signal such as, for example, a negative pulse signal generated after a positive pulse signal is successively generated twice.

When a lapse of the injector drive prohibition period is thus detected by counting the number of times of generation of the output pulse from the signal generator, it is impossible to determine the type of a pulse signal first generated after start of the starting operation, resulting in a length of the injector drive prohibition period being rendered uniform or constant. However, even when the injector drive prohibition period is shortest, setting of a length of the period which permits the length to satisfy predetermined conditions does not cause any problem.

The embodiment shown in FIG. 2 is so constructed that the exciting coil RY of the relay is driven by the voltage Vc across the power capacitor 3*c*. However, such construction would often cause the exciting coil RY to exhibit increased load. Such a disadvantage may be effectively eliminated by driving the exciting coil by another generating coil arranged in the magneto.

The above-described embodiments each are constructed so as to make much account of operation of the injector. More specifically, in each of the embodiments, the injector drive prohibition period is defined to be a period of time required to permit charges in an amount required for driving the injector to be accumulated in the power capacitor. Alternatively, assurance of a predetermined fuel feed pressure during initial or first fuel injection may be taken into consideration. In this instance, a length of the injector drive prohibition period may be set so as to prohibit driving of the injector during a period of time required to increase a fuel feed pressure to a predetermined level after start of starting operation of the engine. Such setting of the injector drive prohibition period promotes charging of the power capacitor during the injector drive prohibition period while prohibiting discharge of the power capacitor, resulting in reducing a delay of start of operation of the injector as compared with when discharge of the power capacitor is initiated immediately after initiation of the starting operation.

Also, in each of the embodiments described above, the injection command signal generating section 2 comprises the main injection command signal generating portion using a microcomputer and the auxiliary injection command signal generating portion using a hardware circuit. Alternatively, only any one of the injection command signal generating portion using a microcomputer and that using a hardware circuit may be provided for this purpose.

As can be seen from the foregoing, the present invention is constructed so as to set the injector drive prohibition period during which driving of the injector is prohibited after start of starting operation of the engine, during which charging of the power capacitor is proceeded. Such construction permits rising of the voltage across the power capacitor to be advanced as compared with when the driving current is permitted to flow through the injector immediately after initiation of starting operation of the engine, to thereby prevent initiation of operation of the injector from being delayed.

Also, the present invention permits a discharge pressure of the fuel pump to be increased during the injector drive prohibition period, to thereby prevent the amount of fuel initially injected from being insufficient or deficient.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A method for driving an injector for an internal combustion engine comprising the steps of:

providing a power circuit including a magneto driven by the internal combustion engine, a rectifying circuit for rectifying an output of said magneto and a power capacitor charged by means of an output of said rectifying circuit;

applying a voltage induced across said power capacitor to a driving coil of the injector by means of said power circuit;

obtaining information on an angle of rotation of the internal combustion engine and information on an engine speed based on a pulse signal obtained from a signal generator driven by the internal combustion engine, to thereby generate an injection command signal of a predetermined signal width;

feeding a driving current from said power circuit to said driving coil while said injection command signal is generated, to thereby drive the injector;

prohibiting driving of the injector during an injector drive prohibition period which is a predetermined period of time defined after start of starting operation of the internal combustion engine; and permitting driving of the injector after a lapse of said injector drive prohibition period.

2. A method as defined in claim 1, wherein said injector drive prohibition period is a period of time defined so as to permit charges in an amount required for driving the injector to be accumulated in said power capacitor after start of starting operation of the internal combustion engine.

3. A method as defined in claim 1, wherein said injector drive prohibition period is a period of time defined so as to permit a pressure of fuel fed to said injector to be increased to a predetermined level after start of starting operation of the internal combustion engine.

4. A method as defined in claim 1, wherein said injector drive prohibition period is longer one of a period of time defined so as to permit charges in an amount required for driving the injector to be accumulated in said power capacitor after start of starting operation of the internal combustion engine and a period of time defined so as to permit a pressure of fuel fed to said injector to be increased to a predetermined level after start of starting operation of the internal combustion engine.

5. A method as defined in any one of claims 1 to 4, further comprising a step of detecting a lapse of said injector drive prohibition period when said voltage across said power capacitor reaches a predetermined level.

6. A method as defined in any one of claims 1 to 4, further comprising a step of detecting a lapse of said injector drive prohibition period based on the number of times of generation of said pulse signal generated from said signal generator after start of starting operation of the internal combustion engine.

* * * * *